US006123271A

United States Patent [19]

Delaney et al.

[11] Patent Number: 6,123,271

[45] Date of Patent: Sep. 26, 2000

[54] VESSEL CLEANING APPARATUS

[75] Inventors: Robert E. Delaney, Devon; Minh Quang Le, Exton; Bentley F. Gleeson, Norristown; Warren F. Geiger, Lansdale, all of Pa.

[73] Assignee: Gamajet Cleaning Systems, Inc., Malvern, Pa.

[21] Appl. No.: 09/220,984

[22] Filed: Dec. 23, 1998

[51] Int. Cl.[7] ..... B05B 3/00

[52] U.S. Cl. ..... 239/227; 239/240; 239/246

[58] Field of Search ..... 239/225.1, 227, 239/240, 243, 246, DIG. 1, DIG. 13

[56] References Cited

U.S. PATENT DOCUMENTS

| | | | |
|---|---|---|---|
| 2,955,764 | 10/1960 | Hruby, Jr. | 239/206 |
| 3,131,867 | 5/1964 | Miller et al. | 239/97 |
| 3,275,241 | 9/1966 | Saad | 239/227 |
| 3,326,468 | 6/1967 | Bristow et al. | 239/227 |
| 3,334,817 | 8/1967 | Miller et al. | 239/113 |
| 3,464,632 | 9/1969 | Bristow | 239/227 |
| 3,496,949 | 2/1970 | Mercer | 134/179 |
| 3,526,363 | 9/1970 | Hauser | 239/206 |
| 3,584,790 | 6/1971 | Bonfield | 239/227 |
| 3,637,138 | 1/1972 | Rucker | 239/227 |
| 3,791,583 | 2/1974 | Nunlist et al. | 239/227 |
| 3,834,625 | 9/1974 | Barthod-Malat | 239/227 |
| 3,874,594 | 4/1975 | Hatley | 239/227 |
| 3,885,740 | 5/1975 | Sugino et al. | 239/227 |
| 3,902,670 | 9/1975 | Koller et al. | 239/227 |
| 3,910,499 | 10/1975 | Trouilhet | 239/228 |
| 4,214,705 | 7/1980 | Watts et al. | 239/227 |
| 4,244,524 | 1/1981 | Wellings | 239/227 |
| 4,351,478 | 9/1982 | Looper | 239/227 |
| 4,353,507 | 10/1982 | Kah, Jr. | 239/240 |
| 4,501,391 | 2/1985 | Hunter | 239/97 |
| 4,662,565 | 5/1987 | Waldrum | 239/236 |
| 4,664,720 | 5/1987 | Rucker | 134/22.1 |
| 4,708,290 | 11/1987 | Osmond | 239/227 |
| 4,783,004 | 11/1988 | Lockwood | 239/205 |
| 4,798,334 | 1/1989 | Harrington | 239/227 |
| 4,842,201 | 6/1989 | Hunter | 239/396 |
| 4,867,379 | 9/1989 | Hunter | 239/240 |
| 4,967,961 | 11/1990 | Hunter | 239/240 |
| 5,012,976 | 5/1991 | Loberg | 239/227 |

(List continued on next page.)

OTHER PUBLICATIONS

GAMAJET® IV Reference Guide, Sybron Chemicals, Inc./ Gamajet Equipment Division, First Edition, Nov. 1992.

Sellers Cleaning Systems, ORBI–3™ Masters Limited Access Tank Cleaning Challenges, Bulletin S–03–294, 1994.

Maxon Precision Motors Catalog, Apr. 1994, p. 101.

*Primary Examiner*—Kevin Shaver
*Assistant Examiner*—David Deal
*Attorney, Agent, or Firm*—Woodcock Washburn Kurtz Mackiewicz & Norris LLP

[57] ABSTRACT

An apparatus for cleaning the interior of a vessel by ejecting a rotating stream of fluid. The apparatus features a gear train driven by the fluid received by an inlet, a stationary housing, a rotatable housing mounted for rotation on the stationary housing about a first axis, and a nozzle for ejecting the fluid, the nozzle being rotatably mounted on the rotatable housing so that the nozzle rotates about a second axis. A gear train is located between the inlet and the nozzle. In addition, a first gear, which, along with the gear train, drives rotation of the rotatable housing about the first axis, and a second gear, which drives the rotation of the nozzle housing about the second axis, are disposed on opposite sides of the second axis. A deflector deflects fluid running along the input drive shaft away from the gear train housing and a passage drains the deflected fluid to the surrounding environment. A swirler swirls the fluid upstream of an impeller, used to drive the input drive shaft, by directing the fluid to flow through a number of inclined passages. A plurality of passages are formed in the stationary housing that place it in flow communication with the nozzle housing. The passages are closely circumferentially spaced around the stationary housing.

29 Claims, 13 Drawing Sheets

U.S. PATENT DOCUMENTS 5,056,716 10/1991 Robinson ..... 239/227
5,092,523 3/1992 Rucker et al. ..... 239/240
5,169,069 12/1992 Rucker et al. ..... 239/227
5,172,710 12/1992 Harrington ..... 134/167 R
5,263,906 11/1993 Antonov ..... 74/337 X
5,316,218 5/1994 Bowen ..... 239/246
5,332,155 7/1994 Jager ..... 239/240
5,640,983 6/1997 Sherman, Jr. et al. ..... 134/167 R
5,718,382 2/1998 Jaeger ..... 239/227

VESSEL CLEANING APPARATUS

FIELD OF THE INVENTION

The present invention relates to apparatus for cleaning vessels, such as tanks and barrels, using a pressurized fluid stream. More specifically, the present invention relates to a vessel cleaning apparatus in which the cleaning fluid drives a gear train that rotates one or more spray nozzles so as to provide a wide spray pattern.

BACKGROUND OF THE INVENTION

Vessels, such as tanks, are frequently cleaned by inserting a cleaning machine, which is supplied with heated, pressurized cleaning fluid, through a access port in the vessel. The cleaning machine ejects the cleaning fluid as a high velocity jet that scours the inside walls of the tank so as to effect a cleaning action. In order to obtain as wide a coverage as possible, such cleaning apparatus frequently employ rotating nozzles that sweep around as they eject the cleaning fluid. Cleaning apparatus sold by Gamajet Cleaning Services, Inc., assignee of the current invention, achieve almost 360° coverage by rotating the nozzles around two mutually perpendicular axes. In such apparatus, the rotation of the nozzles is driven by a gear train that is, in turn, driven by the incoming flow of cleaning fluid via an impeller connected to the drive shaft for the gear train. Consequently, such apparatus are sometimes referred to as fluid powered, gear driven tank cleaning machines.

One early version of a fluid powered, gear driven tank cleaning machine, known commercially as the Gamajet III, is shown in U.S. Pat. No. 3,637,138 (Rucker), hereby incorporated by reference in its entirety. In the late 1980's, Gamajet introduced the Gamajet IV cleaning machine, shown in U.S. Pat. No. 5,012,976 (Loberg), hereby incorporated by reference in its entirety, which had a relatively large maximum flow rate of 300 GPM. Like the Gamajet III, the Gamajet IV featured a gear train that comprised numerous stages of pinion and spurs gears that ultimately drove a ring gear fixed on a rotating T-housing assembly so as to cause rotation of the nozzles assembly about the first axis. A bevel gear fixed on the nozzle assembly mated with a bevel gear fixed on a stem housing, which remains stationary, so that rotation of the nozzle assembly about the first axis caused rotation of the nozzles about the second axis. The fluid inlet was formed at one end of the machine, while the gear train was disposed at the other end of the machine. The rotating nozzle assembly was disposed between the inlet and the gear train.

In order to enable the impeller to operate at an efficient speed without causing the nozzles to spin too quickly, which can result in the production of a mist rather than a strong jet, the gear trains of fluid powered, gear driven tank cleaning machines must be capable of high speed reduction. In both the Gamajet III and IV, this high speed reduction is achieved by means of a number of successive stages of spur and pinion gears. In each stage, a small input pinion gear turns a large output spur gear, thereby causing an incremental speed reduction. The output spur gear of that stage is connected to a small input pinon gear of the next stage, and so on. Unfortunately, this approach results in a relatively large gear train. Thus, the gear box of the Gamajet IV is over four inches in diameter. When combined with the nozzle housing, the width of the machine is about 6 inches so that the minimum entry opening for is over 6 inches. Consequently, such machines cannot be used in some applications, such as small tanks, which feature relatively small ports. Moreover, Gamajet IV machines were relatively heavy, approximately 30 lbs, making their manipulation during installation and use difficult.

In 1994, Gamajet introduced the Gamajet V tank cleaning machine, which is shown in U.S. Pat. No. 5,954,271 (Minh) (application Ser. No. 08/821,171), hereby incorporated by reference in its entirety. The gear train of the Gamajet V featured three stages of gears rotating within a rotating cylindrical ring gear. The first and second stages are planetary gears, while the third stage are stationary gears. A first pinion gear, which is driven by the impeller shaft, drives the first stage of planetary gears. The first stage of planetary gears drives a second pinion gear that then drives the second stage of planetary gears. The second stage of planetary gears drives a third pinion gear that then drives the stationary third stage of gears. The stationary gears of the third stage drive the cylindrical ring gear. The cylindrical ring gear drives a pinion gear that, via idler gears, drives the ring gear that rotates the nozzle assembly. As in the Gamajet IV, the fluid inlet of the Gamajet V was formed at one end of the machine, the gear train was disposed at the other end of the machine, and the rotating nozzle assembly was disposed between the inlet and the gear train.

As a result of its configuration, the gear train of the Gamajet V is housed in a gear box having a diameter of approximately only 2 inches. This is only one-half the diameter of the Gamajet IV gearbox. As a result of the reduced size of the gear box, together with the use of a compact nozzle housing, the Gamajet V can be easily inserted into a 3 inch diameter access port. In addition, the Gamajet V is relatively light weight, weighing only about 7 lbs.

While a significant advancement over prior art machines, the Gamajet V has drawbacks in certain applications. First, the diameter of the Gamajet V is still too large to enter through very small access ports, such those found in wine barrels, which have access ports that are only about 1½ inch in diameter. Consequently, it would be desirable to develop a cleaning machine capable of being installed in access ports as small as 1½ inches. Second, although the planetary gear box is sealed, fluid can sometimes leak into the gear box of the Gamajet V if the seals are compromised. Such leakage is more likely to occur when the machine is utilized in a vertical orientation with the fluid inlet at the top, since fluid collecting in the bottom of the machine will surround the planetary gear box. Consequently, it would be desirable to develop a cleaning machine that was more resistant to leakage of fluid into the gear box.

Although the Gamajet V's capability of operating at low flow rates has advantages in some applications, other applications require flow rates higher than the 40 GPM maximum flow rate capability of the Gamajet V. Moreover, the diameter or width-wise dimension of the machine is not the only relevant dimension. Large tanks, which require the large flow rate capability of the Gamajet IV, feature oval access ports in which the width is greater than the height, the height typically being only about 18 inches. When cleaning such tanks, the cleaning machine is sometimes assembled in the vertical orientation onto a base so that it can be gradually rolled along the bottom of the vessel during the cleaning cycle. Unfortunately, the length of a Gamajet IV, which is approximately 12½ inches, prevents the insertion of such an assembly through the access port in the vertical orientation. As a result, the assembly, including the base unit and the cleaning machine, must be rotated 90 before being inserted through the port. This operation is difficult and awkward, due to the relatively heavy weight of the Gamajet IV machine, as discussed above. Consequently, it would be desirable to develop a cleaning machine that was light and sufficiently short to be easily installed through conventional access ports in the vertical orientation, even when mounted on a roller assembly.

Moreover, in the Gamajet V, like the Gamajet III and IV machines, cleaning fluid flowed into the nozzle assembly by flowing radially outward through a stem housing on which the nozzle assembly was rotatably mounted. This was accomplished by forming four large openings circumferentially spaced around the stem housing. Unfortunately, this arrangement can cause the flow rate of the cleaning fluid to pulse as the inlet to the nozzle assembly rotates past the openings. Consequently, it would be desirable to develop a cleaning machine with a more uniform flow rate from the nozzles as the nozzle assembly rotates about its axis.

In fluid powered, gear driven tank cleaning machines, the high torque loading imposed as a result of the combined rotation of the nozzles about two perpendicular axes can impose excessive loading on the bearing that support the nozzle assembly. This is especially true in large, high flow rate machines, which necessarily require high torque loads to establish rotation. Consequently, it would be desirable to develop a cleaning machine that was less susceptible to torque loading.

Finally, in order to maximize the torque imparted to the impeller by the incoming cleaning fluid, it is important to swirl the fluid, i.e., impart a circumferential component to the fluid velocity, before it reaches the impeller. This swirling causes the fluid to spiral into the impeller blades, rather than merely flowing axially into them. Traditionally, such swirling was accomplished by a stator vane assembly located directly upstream of the impeller. The stator vane assembly consisted of stationary vanes oriented at an angle to the impeller axis so as to swirl the cleaning fluid. Unfortunately, cleaning fluid sometimes leaks around the stator vanes, in which case all of the fluid is not swirled. This leakage reduces the torque transmitted to the rotor by the cleaning fluid. Consequently, it would be desirable to develop a cleaning machine in which the fluid was more effectively swirled upstream of the impeller.

SUMMARY OF THE INVENTION

It is an object of the current invention to provide an improved cleaning machine for cleaning the inside of vessels. This object is accomplished in an apparatus for cleaning the interior of a vessel by ejecting a rotating stream of fluid, comprising (i) first and second ends, (ii) an inlet formed in the first end for receiving the fluid, (iii) a gear train driven by the fluid received by the inlet, (iv) a stationary housing, (v) a rotatable housing disposed between the first and second ends and mounted for rotation on the stationary housing about a first axis, and (vi) a nozzle for ejecting the fluid, the nozzle rotatably mounted on the rotatable housing so that the nozzle rotates about a second axis.

In one embodiment of the invention, the gear train is disposed between the inlet and the nozzle, reducing the length of the shaft driving the gear train and permitting fluid that collects in the flow path around the gear train to drain out through the nozzle and away from the gear train. In another embodiment, a first gear drives the rotation of the rotatable housing about the first axis and a second gear drives the rotation of the nozzle housing about the second axis, and in which the first and second gears are disposed on opposite sides of the second axis so that the second gear absorbs a portion of the load imparted to the rotatable housing by the first gear, thereby reducing the loading on the bearing supporting the rotatable housing. Another embodiment features means for preventing fluid from running along the input shaft, which drives the gear train, into the gear train housing by deflecting the fluid away from the shaft, and also features a passage for directing the deflected fluid away from the gear train housing. Another embodiment employs an improved swirler comprised of a body having a plurality of passages, each of which has an inlet opening formed in a front face and an outlet opening formed in a rear face, with each of the passages being oriented at an acute angle to the first axis so that the outlet opening is circumferentially offset from its respective inlet opening. In yet another embodiment, a plurality of passages are formed in the stationary housing that place it in flow communication with the nozzle housing. The passages are circumferentially spaced around the stationary housing by an incremental angle no greater than about 22.5° so as to provide a more uniform flow rate to the nozzle housing.

DESCRIPTION OF THE PREFERRED EMBODIMENT

Figure 1:
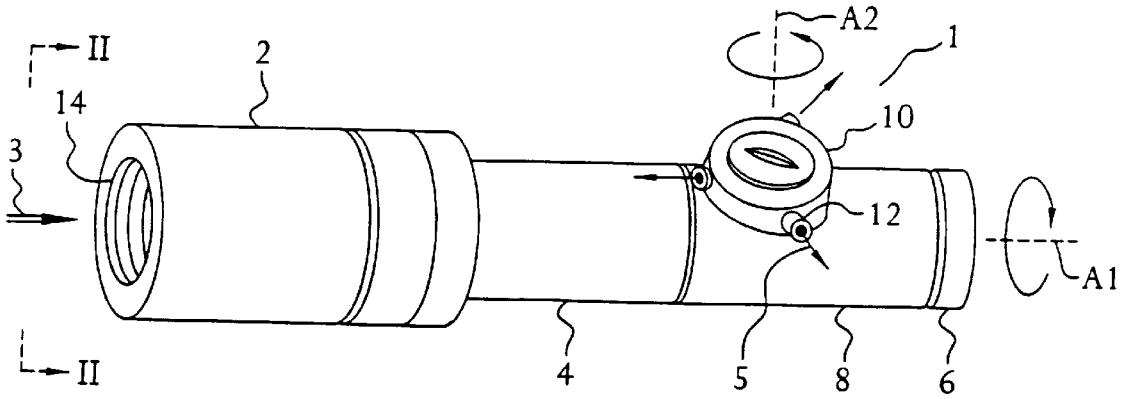
FIG. 1 is an isometric view of a first embodiment of a nozzle cleaning machine according to the current invention.
Figure 2:
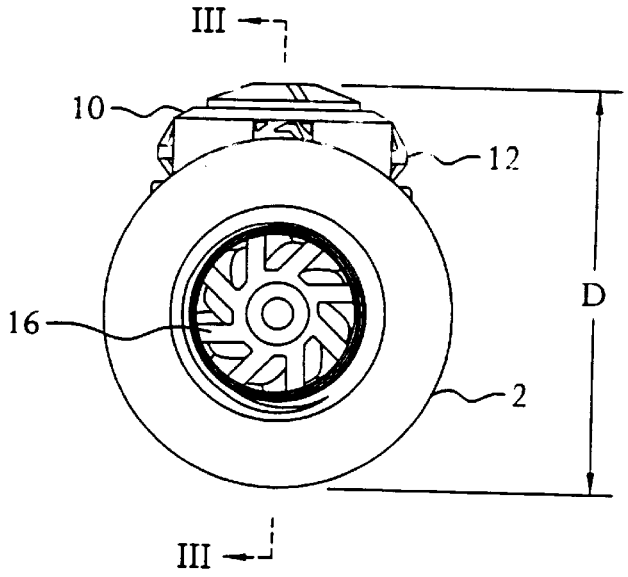
FIG. 2 is an end view of the cleaning machine shown in FIG. 1 taken along line II—II shown in FIG. 1.

One preferred embodiment of a vessel cleaning machine 1 according to the current invention is shown in FIGS. 1–9. The cleaning machine 1 is primarily comprised of a stationary structure and a rotating structure. As shown in FIGS. 1 and 2, the stationary structure is comprised of an inlet housing 2, a stem housing 4 and a base 6. An inlet 14 is formed within the inlet housing 2 and forms one end of the machine. The other end of the machine is formed by the base 6. The rotating structure is comprised of a rotating T-housing 8 and nozzle housing 10 mounted on the T-housing. Preferably, three spray nozzles 12 are mounted on the nozzle housing 10.

In operation, pressurized cleaning fluid 3 is supplied to the machine inlet 14, for example via a hose threaded into the inlet housing 2. As discussed more fully below, the fluid 3 drives gearing that causes the T-housing 8, including the nozzle housing 10, to rotate about axis A1 and causes the nozzle housing to rotate about axis A2, which is preferably perpendicular to axis A1. Eventually, the cleaning fluid 5 is ejected from the spray nozzles 12. Since the nozzles rotate about both axes A1 and A2, the spray pattern they produce provides essentially 360° coverage so as to provide effective cleaning of the vessel walls.

Figure 3:
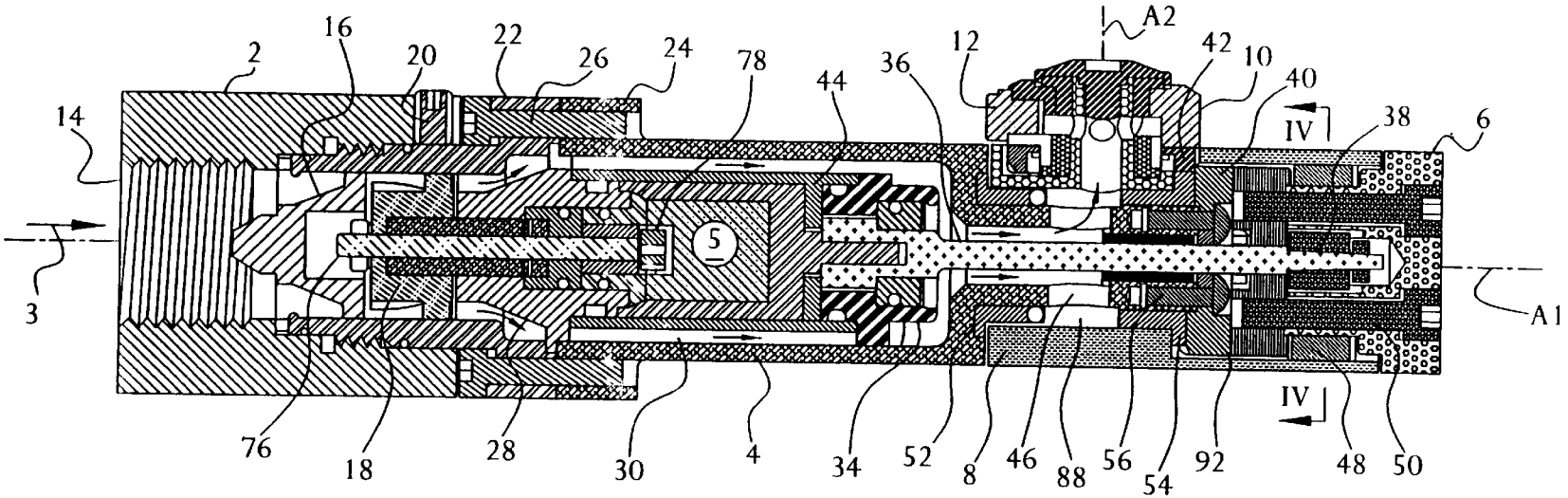
FIG. 3 is a longitudinal cross-section of the cleaning machine shown in FIG. 1 taken along line III—III shown in FIG. 2.
Figure 7:
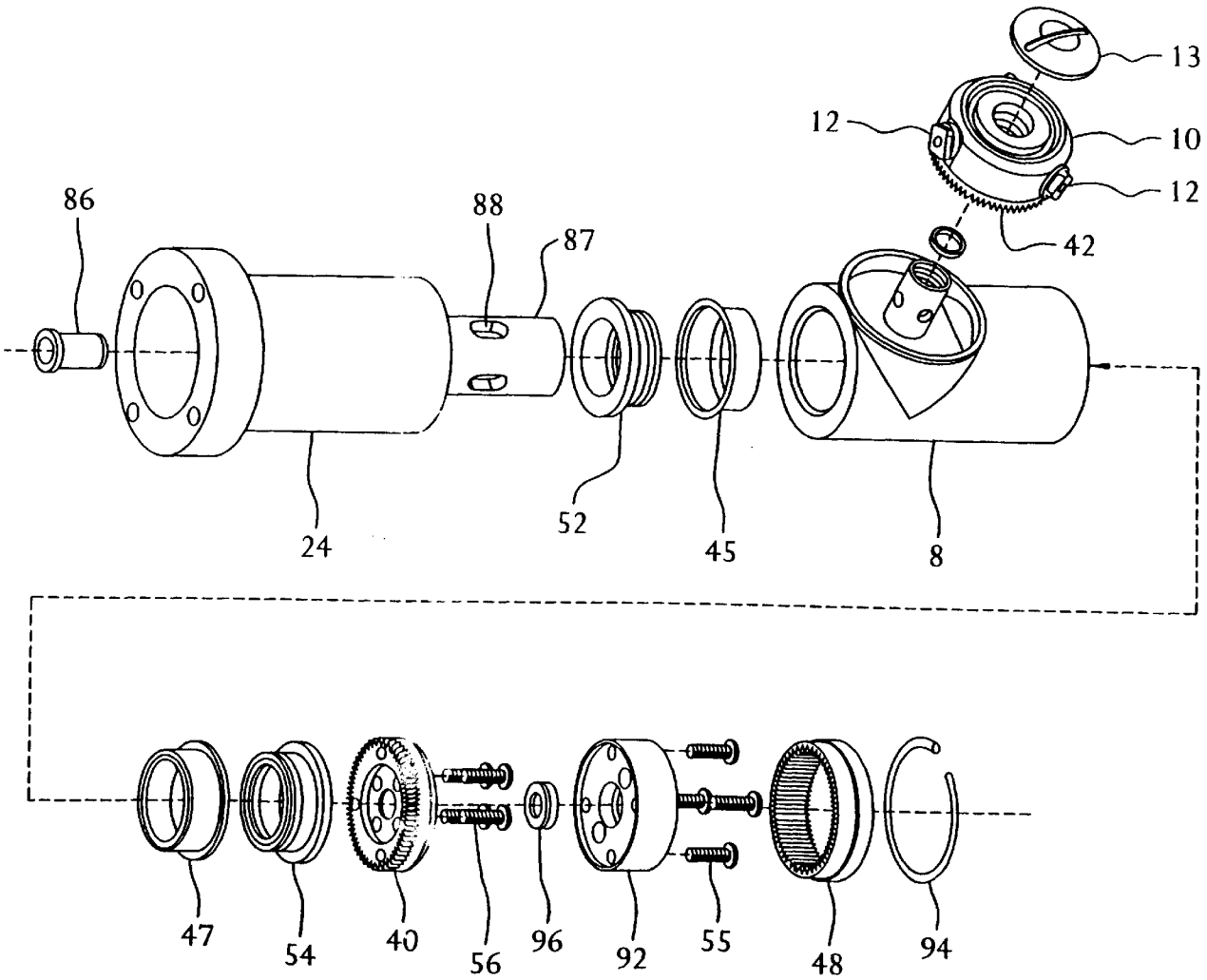
FIG. 7 is an exploded view of the nozzle body assembly shown in FIG. 5.

FIGS. 3–7 show the cleaning machine 1 in more detail. The inlet housing 2 is threaded onto the cap 22 of the stem housing 4 and secured by means of a set screw 20. The stem cap 22 is attached by screws 26 to the stem housing body 24. As shown in FIGS. 3 and 7, the T-housing 8 is mounted on front and rear cups 45 and 47, respectively, that are mounted on front and rear bearings 52 and 54, respectively. The bearings 52 and 54 are mounted on a reduced diameter portion 87 of the body 24 of the stem housing 4. This arrangement enables the T-housing to rotate about the centerline of the stem housing 8, which forms the axis A1.

A swirler 16, having stationary vanes as discussed above, is mounted within the stem cap 22 and serves to pre-swirl the incoming stream of pressurized cleaning fluid 3. After exiting the swirler 16, the cleaning fluid flows over an impeller 18, to which it imparts sufficient torque to rotate an input drive shaft 76 on which the impeller is mounted. The input drive shaft 76 is supported by an upper bearing housing 28 in which a bearing 72, containing a carbide sleeve 66, is mounted. An input pinion gear 78 mounted on the end of the input drive shaft 76 drives a planetary gear train 5. A seal 70, which preferably includes an O-ring, prevents leakage of cleaning fluid into the planetary gear train 5.

Figure 9:
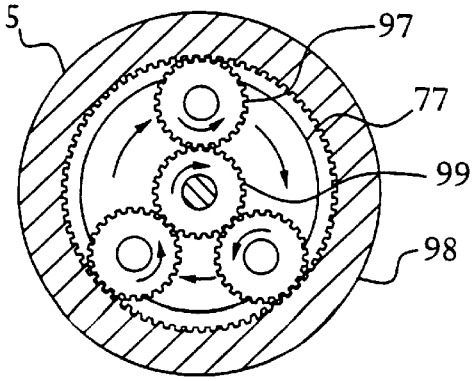
FIG. 9 is a transverse cross-section through the planetary gear train shown in FIG. 8 taken along line IX—IX shown in FIG. 8.
Figure 5:
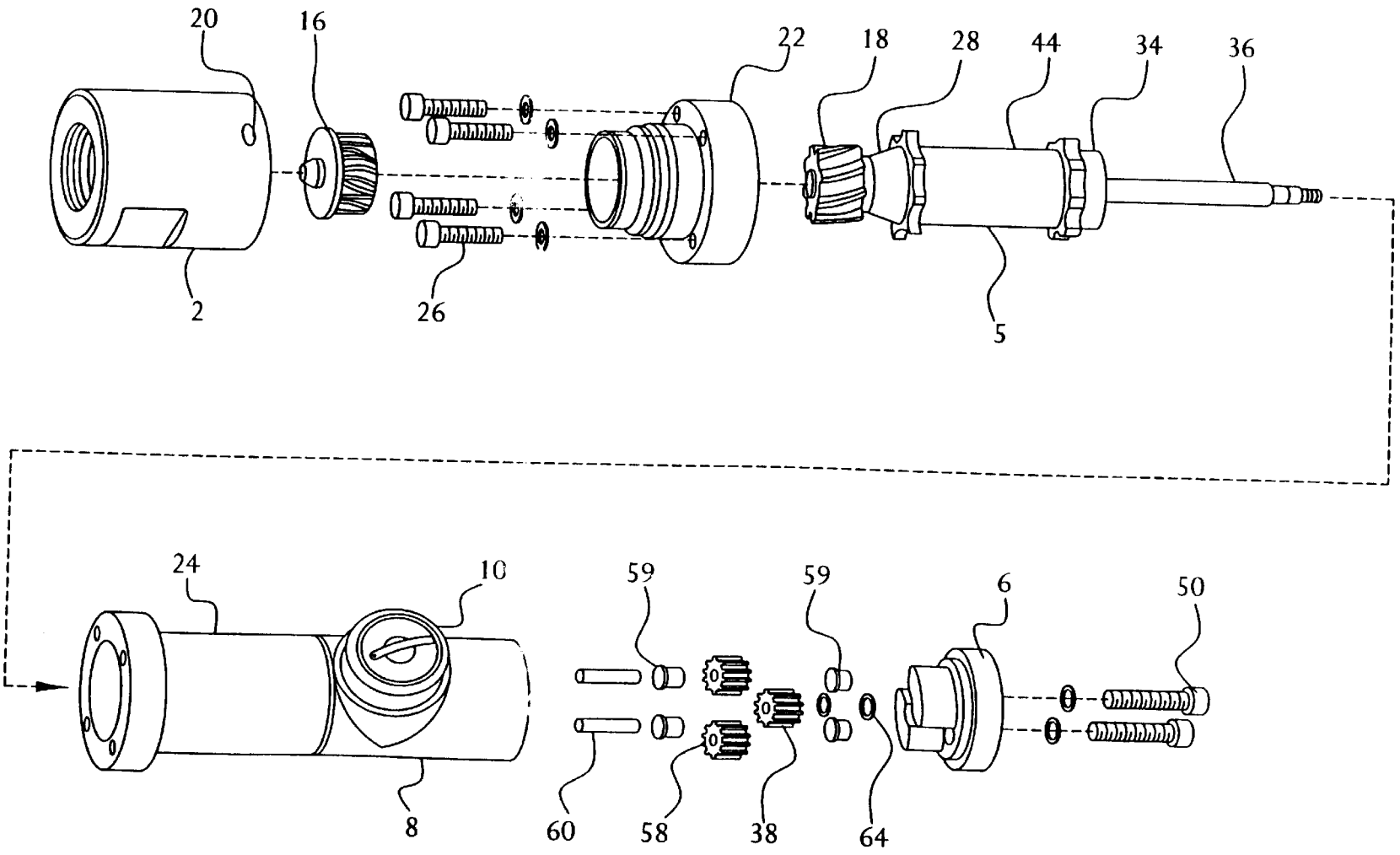
FIG. 5 is an exploded view of the cleaning machine shown in FIG. 1.
Figure 6:
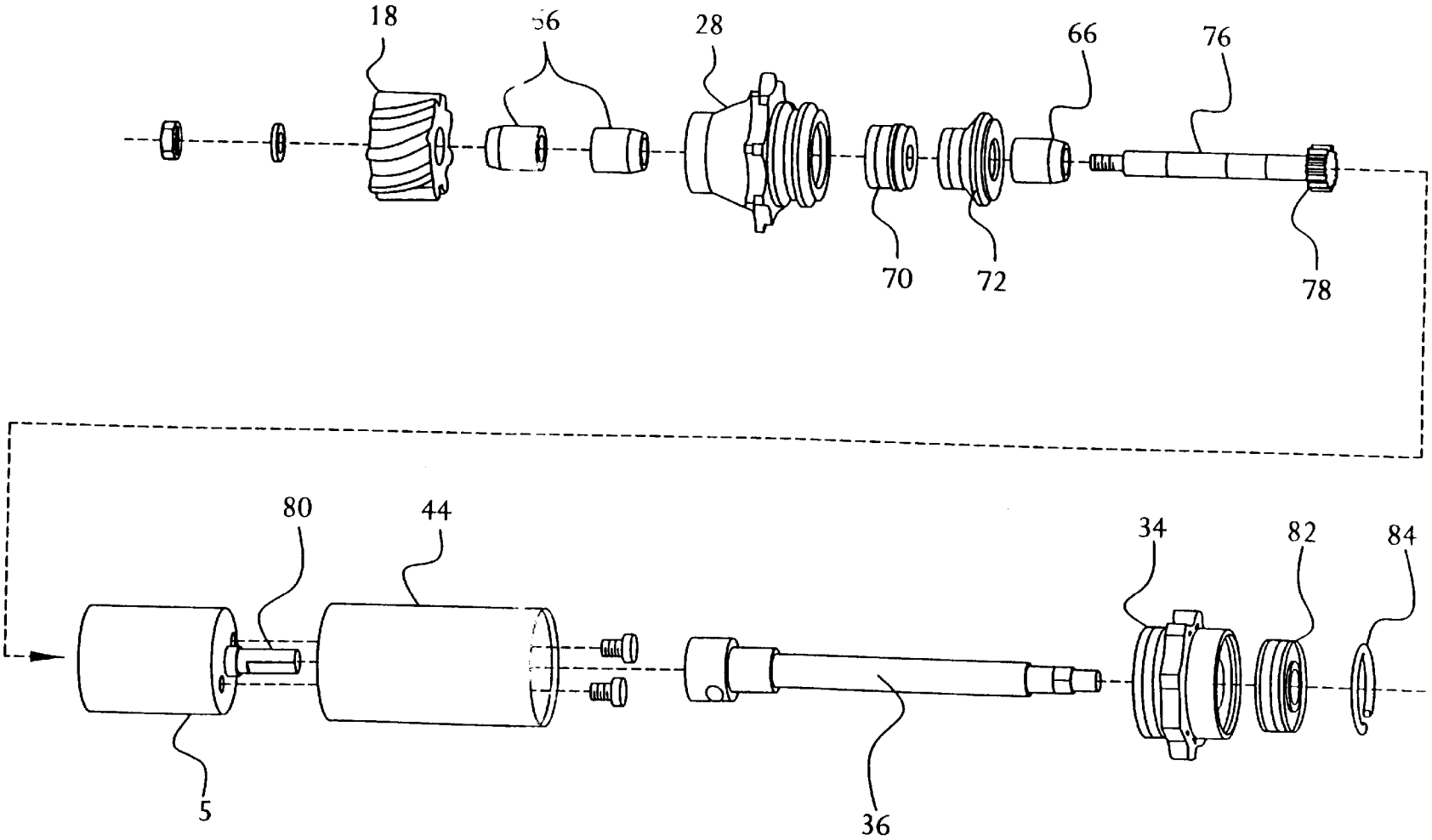
FIG. 6 is an exploded view of the drive train assembly shown in FIG. 5.

The planetary gear train 5 is enclosed within a gear housing 44. As shown in detail in FIGS. 8 and 9, the planetary train 5 is comprised of three stages of planetary gearing, one of which is shown in FIG. 9, and each of which includes three planetary gears 91 that are driven by a pinion gear 93. Each stage of planetary gears 91 rotate within a cylindrical ring gear 98 and cause rotation of a support member 77 that drives the pinion gear 93 of the next stage. The last support member 77 drives the planetary gear train output shaft 80. Returning to FIG. 3, the planetary gear train output shaft 80 is connected to an output drive shaft 36. Preferably, the speed reduction achieved by the planetary gear train 5 is at least about 128:1.

Figure 4:
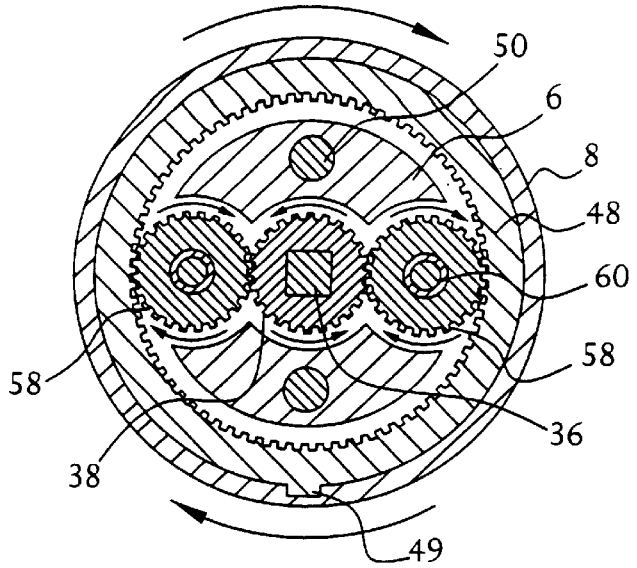
FIG. 4 is a transverse cross-section taken along line IV—IV shown in FIG. 3.
Figure 8:
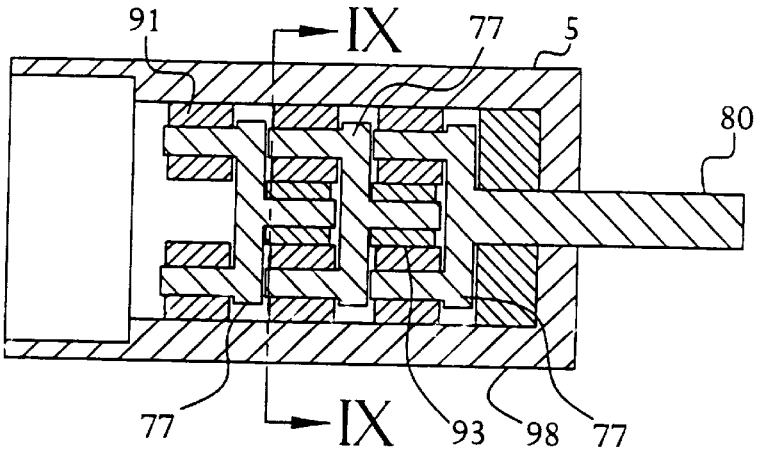
FIG. 8 is a detailed longitudinal cross-section of the planetary gear train shown in FIG. 3.

The front end of the output drive shaft 36 is supported by a rear bearing housing 34 in which a seal 82, retained by a lock ring 84, is disposed. As shown in FIG. 3, an output pinion gear 38 is mounted on the end of the output drive shaft 36. As shown best in FIG. 4, the output pinion gear 38 drives two idler gears 58 that are supported by shafts 60. The shafts 60 extend between an idler shaft base 92 and the base 6. The idler shaft base 92 is secured to the stem housing by screws 55, shown in FIG. 7, while the base 6 is secured to the idler shaft base by means of screws 50, as shown in FIG. 3. As shown in FIG. 4, the idler gears 58 drive a ring gear 48, retained in the T-housing 8 by means of a lock ring 94. The ring gear 48 is fixed to the T-housing 8 by means of a key 49 so that rotation of the ring gear 48 drives rotation of the T-housing.

The gearing shown in FIG. 4 results in an additional speed reduction that is preferably at least about 3.2:1 so that, when combined with the planetary gear train 5, the total gear reduction is at least about 410:1. Consequently, the speed of rotation of the T-housing 8 is reduced by a factor of 410 compared to the speed of rotation of the impeller 18 This arrangement allows the impeller 18 to turn at high speed in order to derive sufficient energy from the cleaning fluid 3 while allowing the nozzles 12 to turn at sufficiently low speed to effect proper cleaning.

As shown in FIG. 3, a stationary bevel gear 40 is attached to the stem housing 4 by means of screws 56. The bevel gear 40 engages a bevel gear 42 fixed to the bottom of the nozzle housing 110. Thus, rotation of the T-housing 8 about axis A1 under the urging of the ring gear 48 and other gearing, shown in FIG. 4, causes the stationary bevel gear 40 to drive the bevel gear 42, thereby causing the nozzle housing 10 to rotate about its axis A2. The gear ratio between the bevel gears 40 and 42 is preferably approximately 1.02:1 so that each 360° revolution of the T-housing 8 causes the nozzle housing 10 to rotate about 354°.

The flow path of the cleaning fluid 3 through the machine will now be discussed with reference to FIG. 3. After flowing over the swirler 16 and the impeller 18, the fluid flows through an annular passage 30. The initial portion of the passage 30 is formed between the stem cap 22 and the upper bearing housing 28. The intermediate portion of the passage 30 is formed between the planetary gear train housing 44 and the stem housing 4 and then between the rear bearing housing 34 and the stem housing. The final portion of the annular passage 30 is formed between the output drive shaft 36 and the stem housing reduced diameter portion 87. The fluid exits the annular passage 30 by turning radially outward and flowing through four large openings 88 formed in the stem housing reduced diameter portion 87 and then into the nozzle housing 10. From the nozzle housing 10, the fluid flows outward through the nozzles 12 as previously discussed.

The arrangement of the components of the cleaning machine 1 according to the current invention, as shown in FIG. 3, has several important advantages over prior machines. First, it results in a very compact structure and facilitates reducing the size of the machine. For example, locating the planetary gear train 5 between the nozzle housing 10 and the inlet 14 places it close to the impeller 18 and thereby reduces the length of the input drive shaft 76, which is subjected to high torque loads. This, in turn, allows the diameter of the input drive shaft 76 to be reduced. Thus, the overall length of the input drive shaft 76 can be reduced to less than one-third the overall length of the machine. By contrast the input drive shaft of the Gamajet V machine is more than one-half its overall length.

By way of example, a commercial embodiment of the cleaning machine shown in FIG. 1, which has a maximum flow rate of about 10 GPM, has a maximum width-wise dimension—that is, a maximum dimension in a direction perpendicular to axis A1, which is indicated as D in FIG. 2—of slightly less than 1.5 inches. Such machine is, therefore, capable of entering 1.5 inch diameter access ports, such as those found on wine barrels. The overall length of such machine is only about 6 inches and it weighs only about 2 lbs.

A second advantage relates to the fact that cleaning machines are typically installed in the vertical orientation, with the inlet 14 at the top. According to the current invention, the planetary gear train 5 is located between axis A2, about which the nozzles 12 rotate, and the inlet 14 so that the cleaning fluid flows over the gear housing 44 on its way to the nozzles; the output drive gear 38, idler gears 58, ring gear 48 and bevel gears 40 and 42 are located between the axis A2 and the base 6. Thus, this arrangement allows cleaning fluid in the area around the planetary gear train 5 to drain out through the nozzles 12. Thus, leakage of cleaning fluid into the planetary gear train 5 is less likely to occur even if the seal 70 is compromised.

Figure 10:
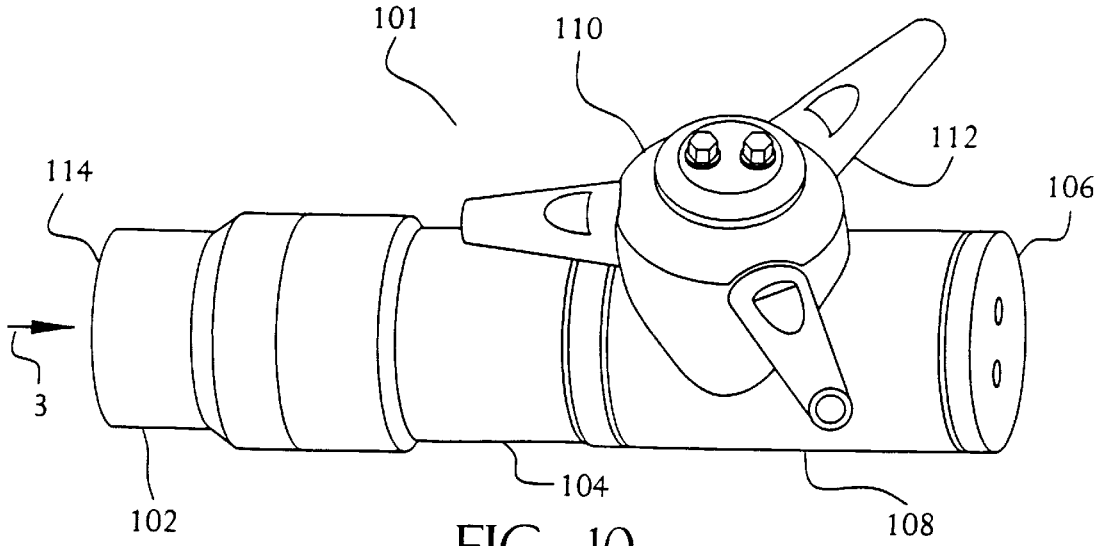
FIG. 10 is an isometric view of a current embodiment of a nozzle cleaning machine according to the second invention.
Figure 22:
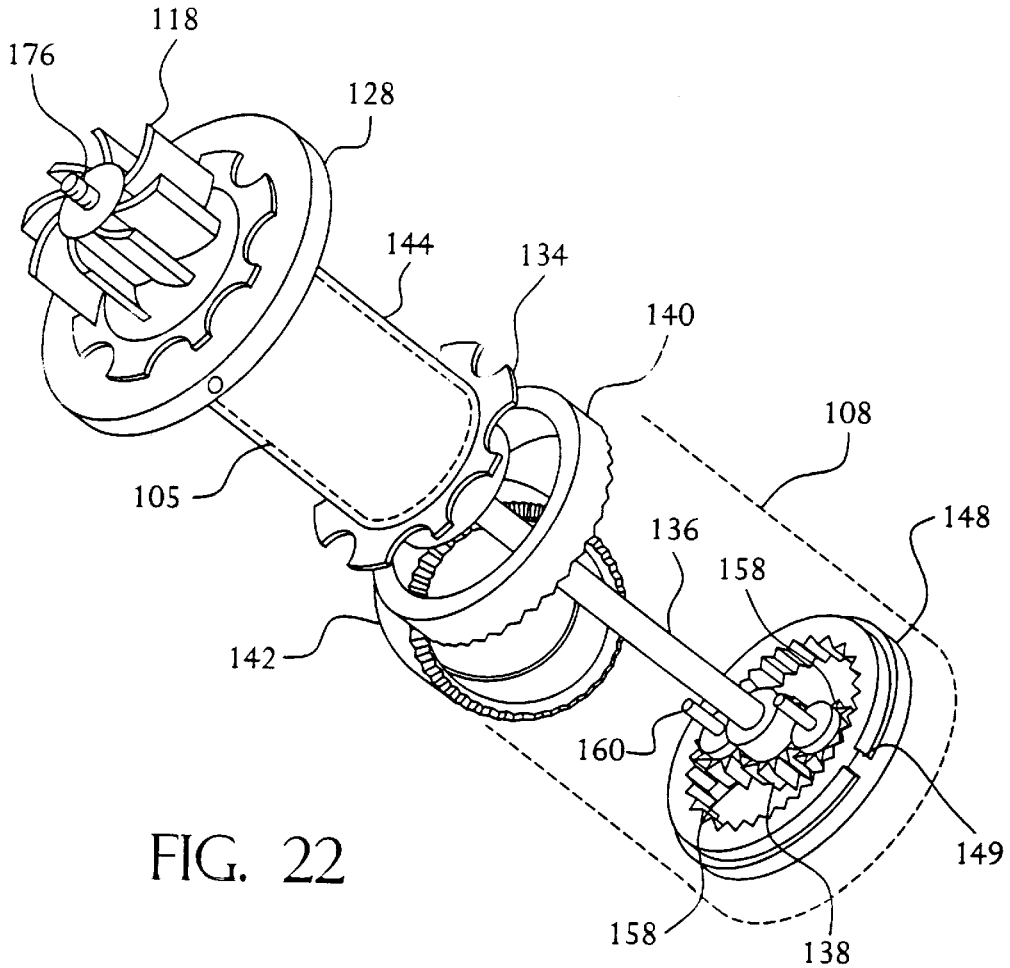
FIG. 22 is an isometric view of the drive train of the cleaning machine shown in FIG. 11.

A second preferred embodiment of the cleaning machine according to the current invention is shown in FIGS. 10–22, in which the reference numeral have been increased by 100 for corresponding components so that, for example, the component identified by reference numeral 128 in the second embodiment corresponds to the component identified by reference numeral 28 in the first embodiment. As shown in FIG. 10, the stationary structure is comprised of an inlet housing 102, a stem housing 104 and a base 106, as before. The rotating structure is comprised of a rotating T-housing 108 and a nozzle housing 110 mounted on bearings 153 on a stem portion 151 of the T-housing. Three spray nozzles 112 are mounted on the nozzle housing 110.

As previously discussed, the fluid 3 drives gearing that causes the T-housing 108, including the nozzle housing 110, to rotate about axis A1 and causes the nozzle housing to rotate about axis A2, which is preferably perpendicular to axis A1. Eventually, the cleaning fluid is ejected from the spray nozzles 112.

FIGS. 11–22 show the cleaning machine 101 in more detail. As shown best in FIG. 11, the inlet housing 102 is threaded onto the cap 122 of the stem housing 104 and secured by means of a set screw 120. The stem cap 122 is attached by screws 126 to the stem housing body 124. The T-housing 108 is rotatably mounted on front and rear cups 145 and 147, respectively, that are mounted on front and rear bearings 152 and 154, respectively, that are mounted on a reduced diameter portion 187 of the body 124 of the stem housing 104, as before.

Figure 14:
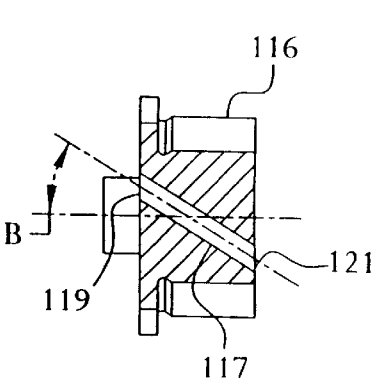
FIG. 14 is a cross-section through the swirler shown in FIG. 13 taken along line XIV—XIV shown in FIG. 13.
Figure 13:
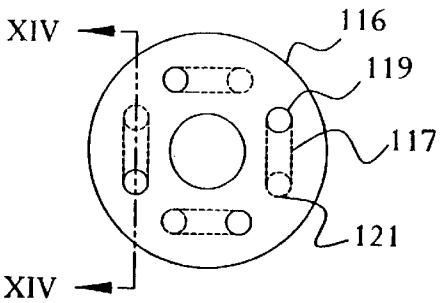
FIG. 13 is a plan view of the swirler shown in FIG. 12 except that the number of passages has been reduced for clarity.
Figure 12:
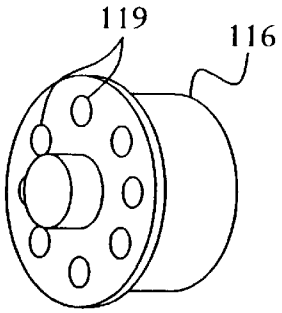
FIG. 12 is an isometric view of the swirler shown in FIG. 11.

However, as shown best in FIGS. 12–14, in this embodiment, the swirler 116 comprises a disc-shaped body having front and rear faces. A number of passages 117 are formed in the swirler 116. Each passage 117 forms an inlet 119 in the front face and an outlet 121 in the rear face. As shown in FIG. 14, while extending generally axially, the passages 117 are oriented at an acute angle B with respect to the axis of rotation of the impeller 118, which is preferably coincident with the axis A1. Preferably, angle B is at least about 30°. As a result, the outlet 121 of each passage 117 is circumferentially displaced from the inlet 119, as shown best in FIG. 13. This enables the passages 117 to swirl the cleaning fluid 3 before it reaches the impeller 118.

Figure 11:
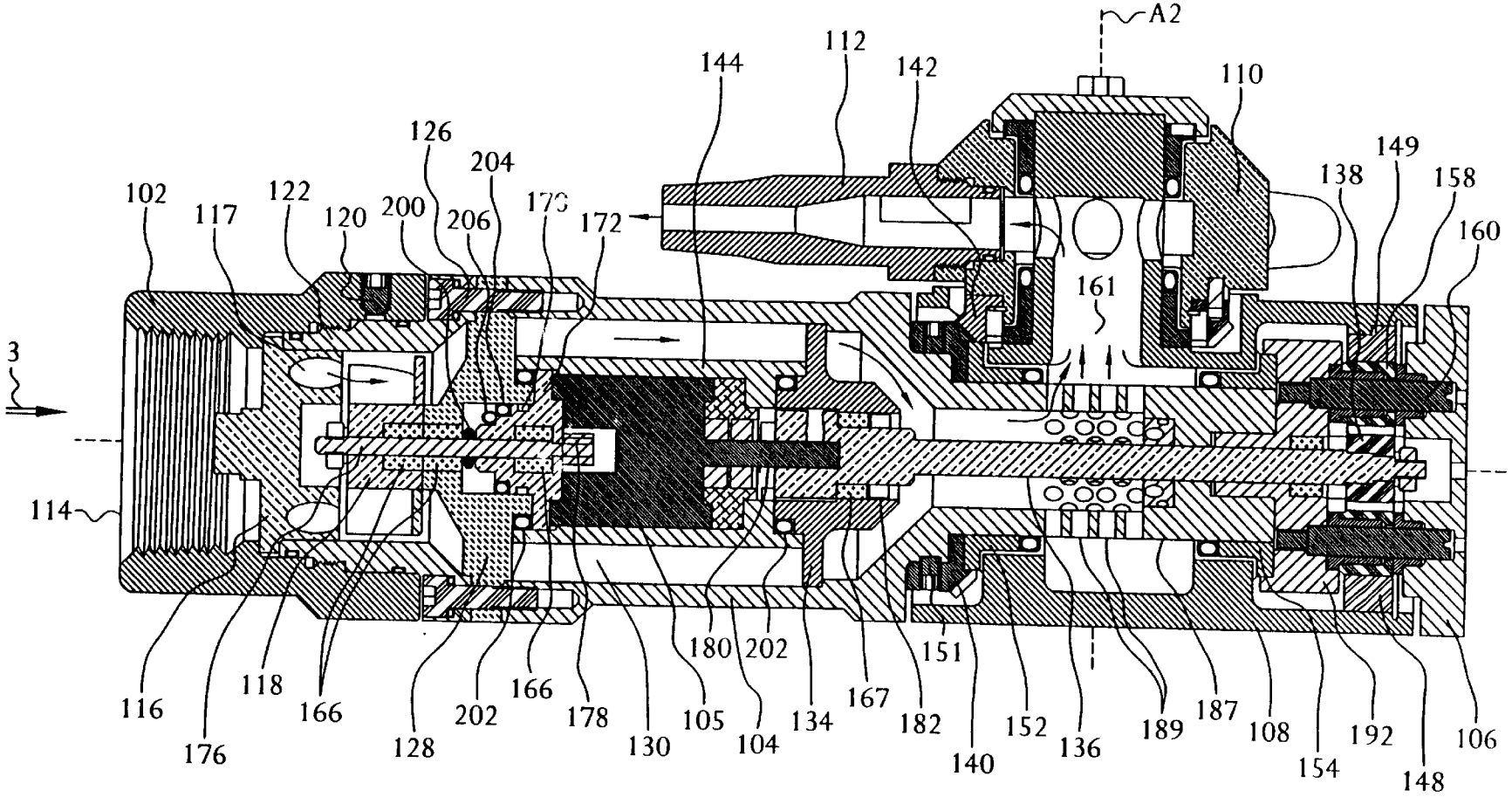
FIG. 11 is a longitudinal cross-section of the cleaning machine shown in FIG. 10.
Figure 15:
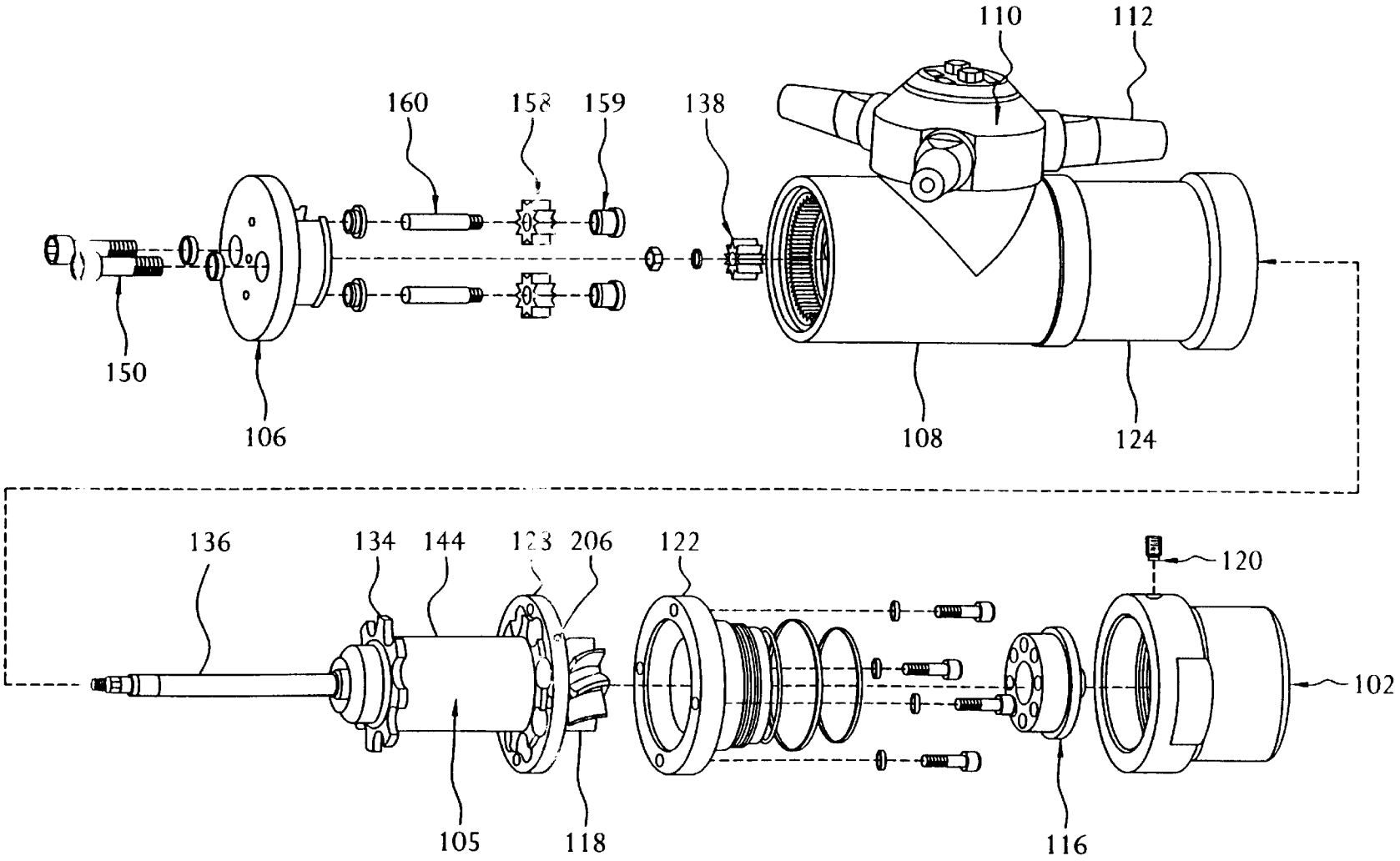
FIG. 15 is an exploded view of the cleaning machine shown in FIG. 10.
Figure 16:
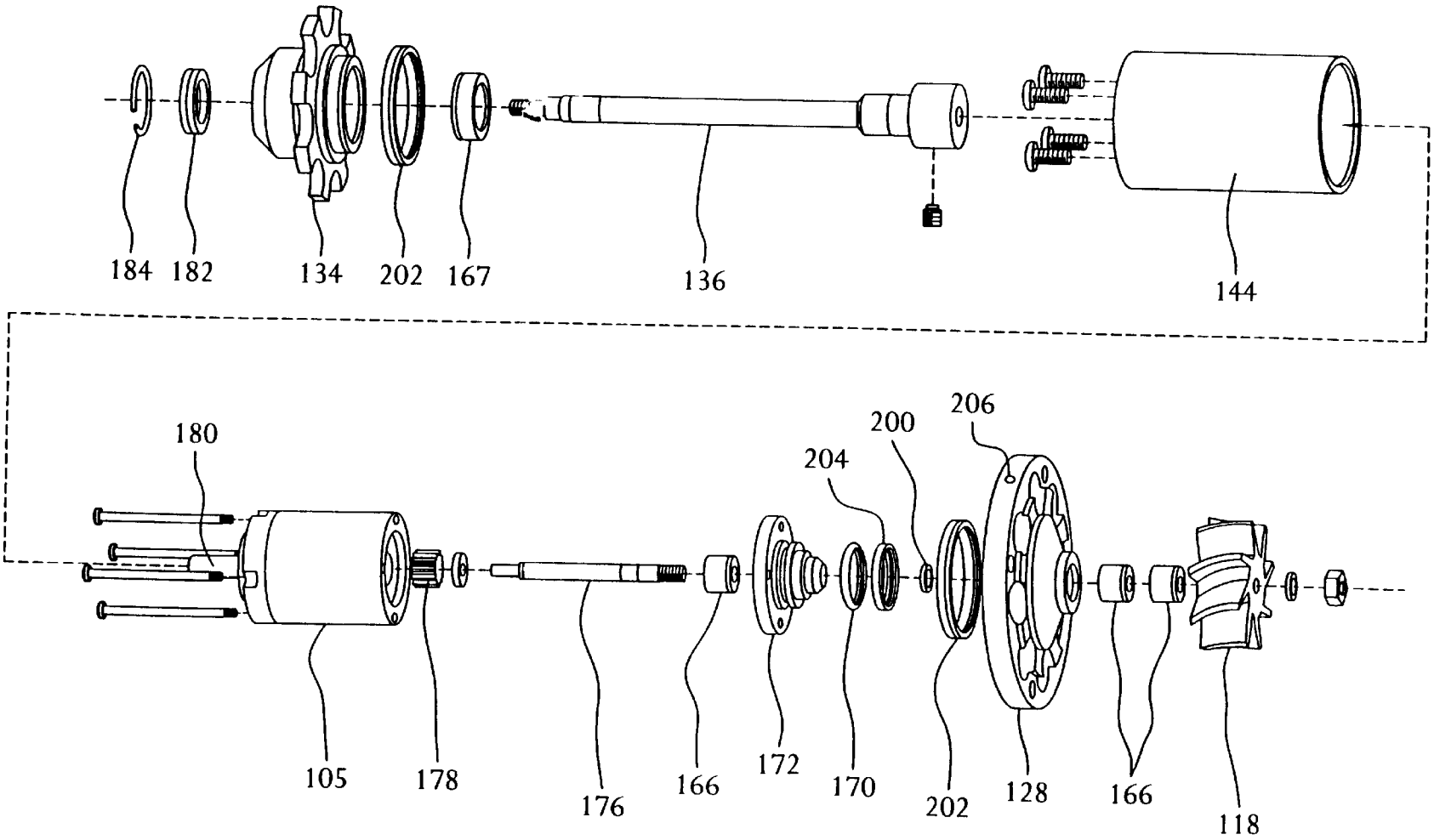
FIG. 16 is an exploded view of the drive train assembly shown in FIG. 15.
Figure 17:
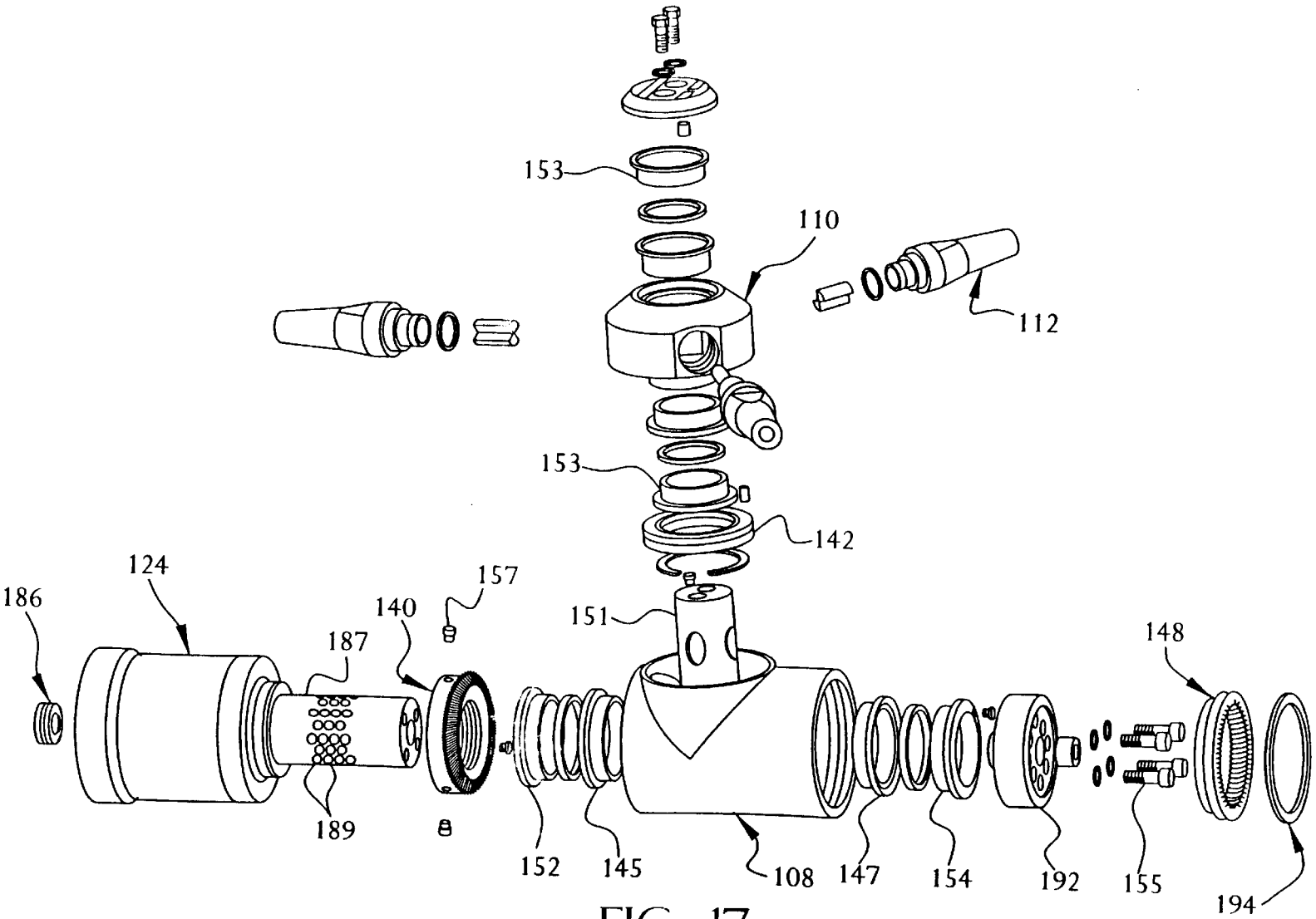
FIG. 17 is an exploded view of the nozzle body assembly shown in FIG. 15.
Figure 18:
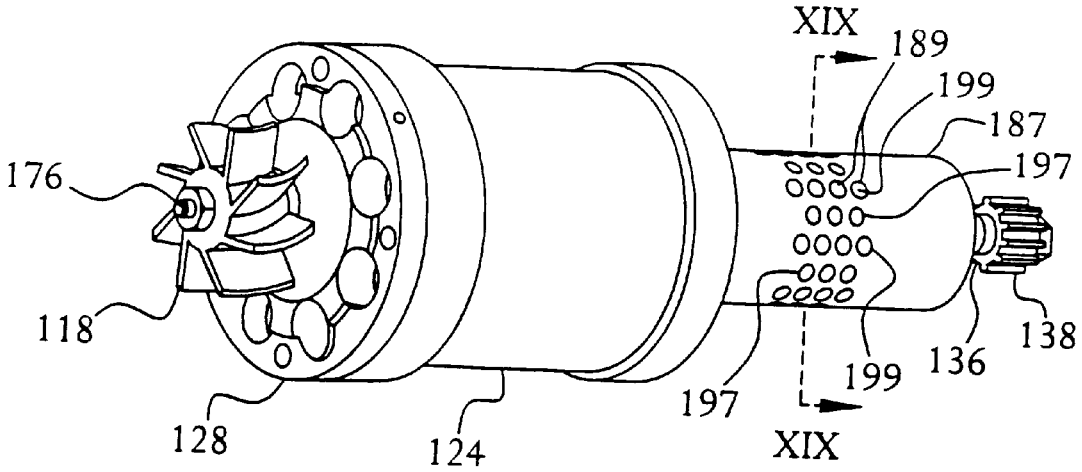
FIG. 18 is an isometric view of the stem housing assembly and impeller shown in FIG. 11.

As shown best in FIG. 11, when using the swirler 116 according to the current invention, all of the fluid 3 must flow through the passages 117 and become swirled. Thus, the problem of fluid leakage around the vanes of conventional swirlers, previously discussed, has been eliminated.

In the embodiment shown in FIG. 11, the input drive shaft 176 is supported by an upper bearing housing 128 in which a bearing 172, containing a carbide sleeve 166, is mounted. The planetary gear train 105, which is similar to the planetary gear train 5 discussed above, is enclosed within a gear housing 144. An input pinion gear 178 mounted on the end of the input drive shaft 176 drives the planetary gear train 105. The planetary gear train output shaft 180 is connected to an output drive shaft 136. The front end of the output drive shaft 136 is supported by a rear bearing housing 134 in which a carbide sleeve 167 and a seal 182, retained by a lock ring 184, are mounted.

Figure 21:
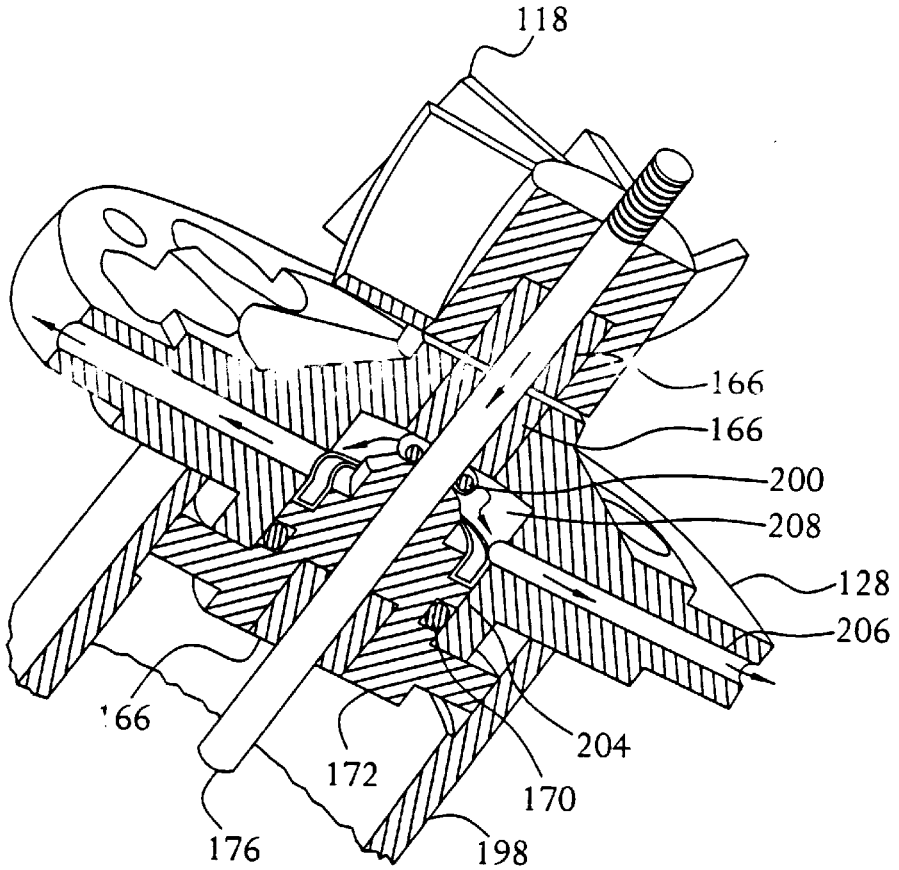
FIG. 21 is a cross-sectional isometric view of the upper bearing housing shown in FIG. 11 taken along line XXI—XXI shown in FIG. 20.

The embodiment shown in FIGS. 10–21 has improved sealing capability with respect to the planetary gear train 105. As shown best in FIG. 21, an O-ring seal 170 is located between the bearing 172 and the bearing housing 128 to prevent leakage of cleaning fluid into the planetary gear train 105, as before. In addition, a first spring loaded static steal 204 seals between the bearing 172 and the bearing housing 128, while a second spring loaded static seal 202 seals between the bearing housing and the planetary gear train housing 144. Further, a drainage chamber 208 is formed within the bearing housing 128 just upstream of the bearing 172. A number of radially extending passages 206 are formed in the bearing housing 128 and connect the drainage chamber 208 to the ambient environment surrounding the cleaning machine 101. In addition, an O-ring 200 is mounted on the input drive shaft 176 in the drainage chamber 208. In operation, fluid running along the input drive shaft 176, indicated by the arrows in FIG. 21, is deflected radially outward by the rotating O-ring 200 before it reaches the upper bearing 172 or the planetary gear train 105. The deflected fluid is collected in the drainage cavity 208 and then discharged from the machine through the passages 206. Thus, according to the current invention, leakage of fluid into the planetary gear train 105 is more positively prevented.

Returning to FIG. 11, an output pinion gear 138 is mounted on the end of the output drive shaft 136. The output pinion gear 138 drives two idler gears 158 that are supported by shafts 160 and bushings 159. The shafts 160 extend between the base 106, which is secured to an idler shaft base 192 via screws 150, and the idler shaft base, which is secured to the stem housing 104 via screws 155. The idler gears 158 drive a ring gear 148, retained in the T-housing 108 by means of a lock ring 194. The ring gear 148 is fixed to the T-housing 108 by means of a key 149 so that rotation of the ring gear 148 drives rotation of the T-housing, resulting in additional speed reduction, as before.

A stationary bevel gear 140 is attached to the stem housing 8 by means of set screws 157. The bevel gear 140 engages a bevel gear 142 fixed to the bottom of the nozzle assembly 110. Thus, rotation of the T-housing 108 about axis A1 under the urging of the ring gear 148 and other gearing causes the stationary bevel gear 140 to drive the bevel gear 142, thereby causing the nozzle housing 110 to rotate about its axis A2, as before. However, as shown best in FIG. 22, in this embodiment, the bevel gears 140 and 142 are located on the other side of the nozzle housing 110 from the ring gear 148—that is, while the ring gear is located between the axis A2 and the end formed by the base 106, the bevel gears are located between the axis A2 and the machine inlet 114. This is in contrast to prior machines, in which the bevel gears and ring gears were both located between the axis A2 and the base 106.

The arrangement of the machine 101 shown in FIGS. 10–22 is very compact, even when sized to achieve relatively high flow rates. Thus, a commercial embodiment of such a cleaning machine has a maximum flow rate of about 100 GPM yet is only about 11 inches long and weighs only 15 lbs. Moreover, the placement of the bevel gears 140 and 142 and the ring gear 148 results in better balancing of the forces, which reduces the loading on the bearings 152 and 154 supporting the T-housing 108. This reduction in bearing loading occurs because a portion of the loading on the T-housing imparted by the ring gear 148 is absorbed by the stationary bevel gear 140. Thus, the bearings, especially front bearing 152, are not as highly loaded.

Figure 19:
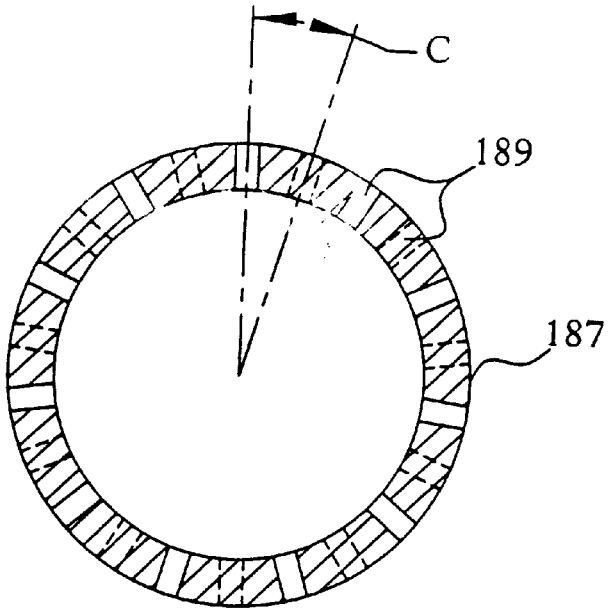
FIG. 19 is a transverse cross-section taken along line XIX—XIX shown in FIG. 18.
Figure 20:
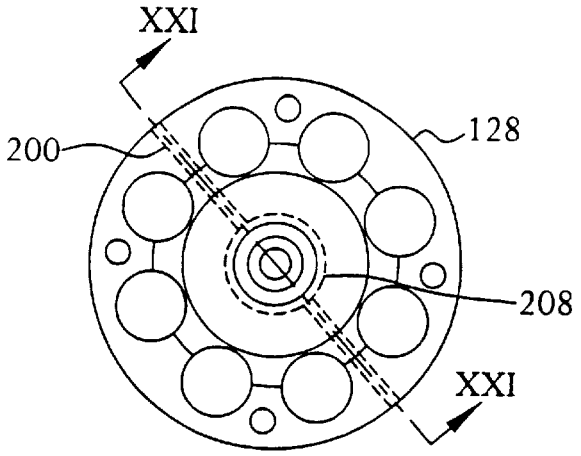
FIG. 20 is an end view of the steam housing assembly shown in FIG. 18.

The flow path of the cleaning fluid 3 through the machine 101 includes an annular passage 130, as before, but differs from that of machine 1 in two principle areas. First, the fluid is swirled by the improved swirler 116, as previously discussed. Second, the fluid exits the annular passage 130 by flowing radially outward through a number of relatively small holes 189 formed in the stem housing reduced diameter portion 187, shown best in FIGS. 18 and 19. Preferably, the holes 189 are arranged in a number of axially extending rows, such as rows 197 and 199 shown in FIG. 18. Preferably, the holes 189 in each axially extending row are staggered so that each hole in row 197 is located between two holes in adjacent row 199 to allow for closer nesting of the rows. Preferably, each row of holes 189 is circumferentially spaced from the adjacent row by an incremental angle C that is no greater than about 22.5°, as shown in FIG. 19. This arrangement is in contrast to the small number of relatively large openings employed in prior machines and results in more uniform flow through the nozzles 112, since the inlet 161 to the nozzle housing 110 does not experience an intermittent large pulse of flow whenever it passes over an opening.

The present invention may be embodied in other specific forms without departing from the spirit or essential attributes thereof and, accordingly, reference should be made to the appended claims, rather than to the foregoing specification, as indicating the scope of the invention.

What is claimed:

1. An apparatus for cleaning the interior of a vessel by ejecting a rotating stream of fluid, comprising:

a) first and second ends;

b) an inlet formed in said first end for receiving said fluid;

c) a gear train driven by said fluid received by said inlet;

d) a rotatable housing disposed between said first and second ends and mounted for rotation about a first axis, a ring gear mounted in said rotatable housing for driving said rotation of said rotatable housing about said first axis;

e) a first rotatable shaft driven by said gear train and driving said ring gear;

f) a nozzle for ejecting said fluid, said nozzle rotatably mounted on said rotatable housing so that said nozzle rotates about a second axis, said second axis disposed between said first and second ends, said ring gear disposed between said second axis and said second end; and g) a flow path directing said fluid from said inlet to said nozzle by directing said fluid to flow around said gear train, said gear train disposed between said inlet and said nozzle, whereby fluid that collects in said flow path around said gear train can drain out through said nozzle and away from said gear train.

2. The vessel cleaning apparatus according to claim 1, further comprising:

h) a second rotatable shaft driving said gear train;

i) means for deflecting fluid running along said second shaft that would otherwise run toward said gear train; and j) a passage for directing said deflected fluid away from said gear train.

3. The vessel cleaning apparatus according to claim 2, wherein said passage is in flow communication with the environment surrounding said apparatus, whereby said passage drains said deflected fluid to said environment.

4. The vessel cleaning apparatus according to claim 2, further comprising a bearing supporting said second shaft, said bearing mounted in a bearing housing, said passage being formed in said bearing housing.

5. The vessel cleaning apparatus according to claim 1, further comprising a bevel gear coupled to said nozzle for driving rotation of said nozzle about said second axis, said bevel gear disposed between said first end and said second axis.

6. The vessel cleaning apparatus according to claim 1, wherein said rotatable housing is disposed proximate said second end.

7. The vessel cleaning apparatus according to claim 1, further comprising:

h) a stationary gear train housing in which said gear train is disposed;

i) a stationary stem housing on which said rotatable housing is mounted, said gear train housing and said stem housing forming at least a portion of said flow path therebetween.

8. The vessel cleaning apparatus according to claim 7, wherein said stem housing encloses said gear train housing, whereby at least said portion of said flow path is annular.

9. An apparatus for cleaning the interior of a vessel by ejecting a rotating stream of fluid, comprising:

a) first and second ends;

b) an inlet for receiving said fluid;

c) an impeller driven by said fluid received by said inlet;

d) a input drive shaft driven by said impeller;

e) a gear train driven by said input drive shaft;

f) an output drive shaft driven by said gear train, said output drive shaft having an output gear mounted thereon;

g) a stationary housing disposed between said first and second ends;

h) a rotatable housing mounted for rotation about said stationary housing so as to be rotatable about a first axis, a ring gear mounted on said rotatable housing for driving said rotation of said rotatable housing about said first axis, said ring gear driven by said output gear; and i) a nozzle for ejecting said fluid, said nozzle mounted on a nozzle housing, said nozzle housing rotatably mounted on said rotatable housing so that said nozzle rotates about a second axis, said gear train disposed between said second axis and said first end.

10. The vessel cleaning apparatus according to claim 9, wherein said first and second ends define a length of said apparatus therebetween, and wherein the length of said input drive shaft is less than one third said length of said apparatus.

11. The vessel cleaning apparatus according to claim 9, wherein said ring gear is disposed between said second axis and said second end.

12. The vessel cleaning apparatus according to claim 11, further comprising a first bevel gear mounted on said stationary housing and a second bevel gear mounted on said nozzle housing, whereby rotation of said rotatable housing about said stationary housing causes rotation of said nozzle housing about said second axis.

13. The vessel cleaning apparatus according to claim 12, wherein said first and second bevel gears are disposed between said first end and said second axis.

14. The vessel cleaning apparatus according to claim 13, wherein said inlet is disposed proximate said first end.

15. The vessel cleaning apparatus according to claim 12, wherein said apparatus has a maximum dimension measured in a direction perpendicular to said first axis, and wherein said maximum dimension is no greater than about 1.5 inches.

16. An apparatus for cleaning the interior of a vessel by ejecting a rotating stream of fluid, comprising:

a) first and second ends;

b) a stationary housing having an inlet formed therein for receiving said fluid;

c) a input drive shaft driven by said fluid received by said inlet;

d) a gear train driven by said input drive shaft;

e) a rotatable housing having first and second ends and mounted for rotation about said stationary housing so as to be rotatable about a first axis, a first gear mounted on said rotatable housing, said first gear driven by said gear train and imparting a load on said rotatable housing for driving said rotation of said rotatable housing about said first axis; and f) a nozzle for ejecting said fluid;

g) a nozzle housing on which said nozzle mounted, said nozzle housing rotatably mounted for rotation about a second axis, a second gear mounted on said stationary housing for driving said rotation of said nozzle housing about said second axis, said first and second gears disposed on opposite sides of said second axis, whereby said second gear absorbs a portion of said load imparted to said rotatable housing by said first gear.

17. The vessel cleaning apparatus according to claim 16, wherein said first gear is a ring gear, and wherein said second gear is a first bevel gear.

18. The vessel cleaning apparatus according to claim 17, further comprising:

h) an output drive shaft driven by said gear train, an output gear mounted on said output drive shaft, said output gear driving an idler gear, said idler gear driving said ring gear; and i) a second bevel gear mounted on said nozzle housing and driven by said first bevel gear.

19. An apparatus for cleaning the interior of a vessel by ejecting a rotating stream of fluid, comprising:

a) an inlet for receiving said fluid;

b) a rotatable housing mounted for rotation about a first axis;

c) a nozzle in flow communication with said inlet for ejecting said fluid received by said inlet, said nozzle rotatably mounted on said rotatable housing so that said nozzle rotates about a second axis;

d) an input shaft driven by said fluid received by said inlet;

e) a gear train driving said rotation of said rotatable housing about said first axis, said input shaft driving said gear train;

f) means for preventing fluid from running along said input shaft into said gear train by deflecting said fluid away from said shaft; and g) a passage for directing said deflected fluid away from said gear train.

20. The vessel cleaning apparatus according to claim 19, wherein said passage is in flow communication with the environment surrounding said apparatus, whereby said passage drains said deflected fluid to said environment.

21. The vessel cleaning apparatus according to claim 19, further comprising a bearing housing supporting said input shaft, said passage being formed in said bearing housing.

22. The vessel cleaning apparatus according to claim 19, further comprising a drainage chamber in which said deflecting means is disposed.

23. The vessel cleaning apparatus according to claim 22, further comprising a bearing housing supporting said input shaft, said drainage chamber being formed in said bearing housing, and wherein said passage is in flow communication with said drainage chamber.

24. The vessel cleaning apparatus according to claim 19, wherein said deflecting means comprises an O-ring mounted on said input shaft.

25. An apparatus for cleaning the interior of a vessel by ejecting a rotating stream of fluid, comprising:

a) an inlet for receiving said fluid;

b) an impeller mounted for rotation about a first axis and over which said fluid received by said inlet flows, whereby said impeller is rotated by said fluid;

c) a rotatable housing mounted for rotation about a second axis;

d) a nozzle in flow communication with said inlet for ejecting said fluid received by said inlet, said nozzle rotatably mounted on said rotatable housing so that said nozzle rotates about a third axis;

e) an input shaft driven by said impeller;

f) a gear train driving said rotation of said rotatable housing about said second axis, said gear train driven by said input shaft; and g) a swirler disposed between said impeller and said inlet for swirling said fluid, said swirler comprising a body having front and rear faces, a plurality of passages formed in said body extending between said front and rear faces, each of said passages having an inlet opening formed in said front face and an outlet opening formed in said rear face, each of said passages being oriented at an acute angle to said first axis so that said outlet opening is circumferentially offset from its respective inlet opening.

26. The vessel cleaning apparatus according to claim 25, wherein said body is disc shaped.

27. The vessel cleaning apparatus according to claim 25, wherein said first and second axes are aligned.

28. The vessel cleaning apparatus according to claim 25, wherein said acute angle at which said passages are oriented is at least about 30°.

29. An apparatus for cleaning the interior of a vessel by ejecting a rotating stream of fluid, comprising:

a) an inlet for receiving said fluid;

b) a stationary housing in flow communication with said inlet;

c) a gear train driven by said fluid received by said inlet;

d) a rotatable housing mounted for rotation about said stationary housing so as to be rotatable about a first axis, said gear train driving said rotation of said rotatable housing about said first axis;

e) a nozzle for ejecting said fluid, said nozzle mounted on a nozzle housing, said nozzle housing rotatably mounted on said rotatable housing so that said nozzle rotates about a second axis; and f) a plurality of passages formed in said stationary housing, said passages placing said stationary housing in flow communication with said nozzle housing, said passages circumferentially spaced around said stationary housing by an incremental angle no greater than about 22°.

* * * * *

UNITED STATES PATENT AND TRADEMARK OFFICE

CERTIFICATE OF CORRECTION

PATENT NO. : 6,123,271

DATED : September 26, 2000

INVENTOR(S) : Delaney et al.

It is certified that error appears in the above-indentified patent and that said Letters Patent is hereby corrected as shown below:

Column 1, Line 15 delete "a access" and insert --an access-- therefor.
Column 1, Line 60, delete "pinon" and insert --pinion-- therefor.
Column 1, Line 65, delete "opening for is over" and insert --opening is over-- therefor.
Column 2, Line 36, delete "such those" and insert --such as those-- therefor.
Column 2, Line 65, delete "rotated 90 before" and insert --rotated 90° before -- therefor.
Column 5, Line 1, delete "steam housing" and insert --stem housing-- therefor.
Column 6, Line 25, delete "impeller 18 This" and insert --impeller 18. This-- therefor.
Column 7, Line 31, delete "numeral have" and insert --numerals have-- therefor.
Column 11, Line 6 of Claim 16, delete "a input" and insert --an input-- therefor.

Signed and Sealed this

Eighth Day of May, 2001

*Attest:*

Nicholas P. Godici

NICHOLAS P. GODICI

*Attesting Officer*

*Acting Director of the United States Patent and Trademark Office*